US006774768B2

(12) United States Patent
Flory, IV

(10) Patent No.: US 6,774,768 B2
(45) Date of Patent: Aug. 10, 2004

(54) SYSTEM AND METHOD FOR CYCLING A METAL-HALIDE LAMP ON AND OFF AT DESIGNATED INTERVALS TO REDUCE RISK OF ARC TUBE RUPTURE

(75) Inventor: Isaac Lynnwood Flory, IV, Blacksburg, VA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/998,754

(22) Filed: Dec. 3, 2001

(65) Prior Publication Data

US 2003/0102962 A1 Jun. 5, 2003

(51) Int. Cl.[7] ..... G08B 1/00

(52) U.S. Cl. ..... 340/309.15; 340/332; 315/119; 315/129; 315/248

(58) Field of Search ..... 340/309.15, 332; 315/248, 119, 129, 291, 326, 59, 307

(56) References Cited

U.S. PATENT DOCUMENTS 6,028,396 A * 2/2000 Morrissey, Jr. et al. ..... 315/119

6,188,183 B1 * 2/2001 Greenwood et al. ..... 315/307

* cited by examiner

*Primary Examiner*—Daryl Pope

(74) *Attorney, Agent, or Firm*—Peter L. Kendall; Alfred N. Goodman

(57) ABSTRACT

An apparatus and method for cycling power to a HID ballast and amp in order to reduce the possibility of arc tube rupture or non-passive end of life light source failure with a warning indicator indicating impending momentary power outage. The apparatus comprises a lamp, a ballast, and a microcontroller operable to generate a warning indicator after expiration of a pre-selected period of time. The warning indicator indicates termination of power to the lamp for a predetermined period of time, by alternatively dimming and increasing the light output of the lamp. After expiration of the pre-determined period of time, the microcontroller restores the power to the ballast. The above described process is repeated periodically in order to reduce the risk of arc tube rupture.

19 Claims, 4 Drawing Sheets

SYSTEM AND METHOD FOR CYCLING A METAL-HALIDE LAMP ON AND OFF AT DESIGNATED INTERVALS TO REDUCE RISK OF ARC TUBE RUPTURE

FIELD OF THE INVENTION

The present invention relates generally to a system and method that cycles a luminaire, such as one containing a metal-halide lamp, on and off at designated intervals in order to reduce the risk of arc tube rupture. More particularly, the present invention relates to a system and method that repeatedly switches the lamp from a high to low power output state before causing the lamp to extinguish, for a brief period of time, in order to provide a warning to anyone in the general vicinity of the luminaire that the lamp is about to be extinguished.

BACKGROUND OF THE INVENTION

High intensity discharge (HID) lamps such as metal halide (MH) and high pressure sodium (HPS) lamps have increasingly gained acceptance over incandescent and fluorescent lamps for commercial and industrial applications. HID lamps are more efficient and more cost effective than incandescent and fluorescent lamps for illuminating large open spaces such as construction sites, stadiums, parking lots, warehouses, and so on, as well as for illumination along roadways. An HID lamp comprises an arc-tube containing at least two electrodes, chemical compounds and a fill gas. The fill gas can comprise one or more gases. To initiate operation of the lamp, the fill gas is ionized to facilitate the conduction of electricity between the electrodes. However, these light sources have been found to be susceptible to non-passive lamp failure, or, arc tube rupture.

Non-passive lamp failures generally occur in response to crack propagation of the associated arc tube. Specifically, when the internal arc tube ages and develops minute faults, the arc tube may fracture allowing high pressure to force hot arc tube fragments through the outer glass jacket. If the associated luminaire is not suitably enclosed, falling arc tube fragments may pose a danger to personnel and property. Many luminaires are not enclosed, and accordingly, non-passive end-of-life light source failure is of concern to lamp and luminaire manufacturers.

To prevent the above described situations, high intensity discharge lamp manufacturers recommend periodic cycling of lamps. Where lamps are used in applications that run continuously, lamp manufacturers require regular cycling, typically once a week. In operation, the high wattage light source such as, for example a HID lamp, is periodically cycled off and then back on. As mentioned above, an arc tube that has developed a weakness will most likely fail passively during the cool down and possibly the subsequent warm up cycle. To accomplish the required cycling of these lamps, the lamps should be de-energized and re-energized, per the lamp manufacturer's recommendations.

Accordingly, an end user could extinguish the lighting from the panel-board on a regular basis, for example, weekly, but there are two flaws in using this method. First, an end user that would operate a facility 24 hours a day/seven days a week would most likely not want to monitor the lighting and whether or not it had been cycled once a week. Secondly, if the end user were to de-energize the luminaire from the panel-board many luminaires would be off at once, probably in the same area, which could become a separate safety issue, in addition to the arc tube failure mentioned above. Although individual timers could be attached to each circuit such an arrangement is a cumbersome solution.

A proposed solution is found in U.S. Pat. No. 6,247,187 to Green, entitled "System for Promoting Passive End of Life Light Source Failure." The Green patent discloses a system which automatically energizes and de-energizes a HID light source, however, no warning system is given of the impending power outage. In many applications the lamps are running continuously and an unexpected power outage could be extremely dangerous. For example, suppose a lift truck operator is 15 feet above the ground, for instance in a warehouse environment, and suddenly the luminaire that they are working under goes dark, the operator can experience momentary disorientation or severe enough confusion that could lead to an unfortunate accident.

Accordingly, a need exists for a warning sequence before a luminaire is cycled off to prevent arc tube failure. The high to low cycling of the lamp is much subtler than an abrupt shutdown of the luminaire and would warn people in the area so that they could prepare mentally and physically for the upcoming outage.

SUMMARY OF THE INVENTION

It is an object of the present invention to provide a luminaire assembly that comprises a warning sequence before the luminaire de-energizes and energizes in order to reduce the risk of non-passive end of life failure or arc tube rupture.

It is a further object of the present invention to have a self-contained, relatively small circuit that allows the warning function to be retrofit into a conventional metal-halide lamp.

It is yet a further object of the present invention to provide a luminaire assembly that is able to withstand high instantaneous power level changes.

It is still a further object of the present invention to provide a luminaire assembly with a warning feature as well as ae cycling feature for a HID lamp employing either a constant wattage ballast or a magnetically regulated ballast.

These and other objects are substantially achieved by a luminaire assembly comprising a lamp, a ballast, and a microcontroller circuit operable to generate a warning indicator after expiration of a pre-selected period of time. The warning indicator indicates the impending termination of power to the lamp for a pre-determined period of time. Upon expiration of the pre-determined period of time, the microcontroller then restores the power to the lamp and resets the internal timing function.

BRIEF DESCRIPTION OF THE DRAWINGS

These and other aspects, advantages and novel features of the invention will be more readily appreciated from the following detailed description when read in conjunction with the accompanying drawings, in which.

DETAILED DESCRIPTION OF THE PREFERRED EMBODIMENTS

Figure 1:
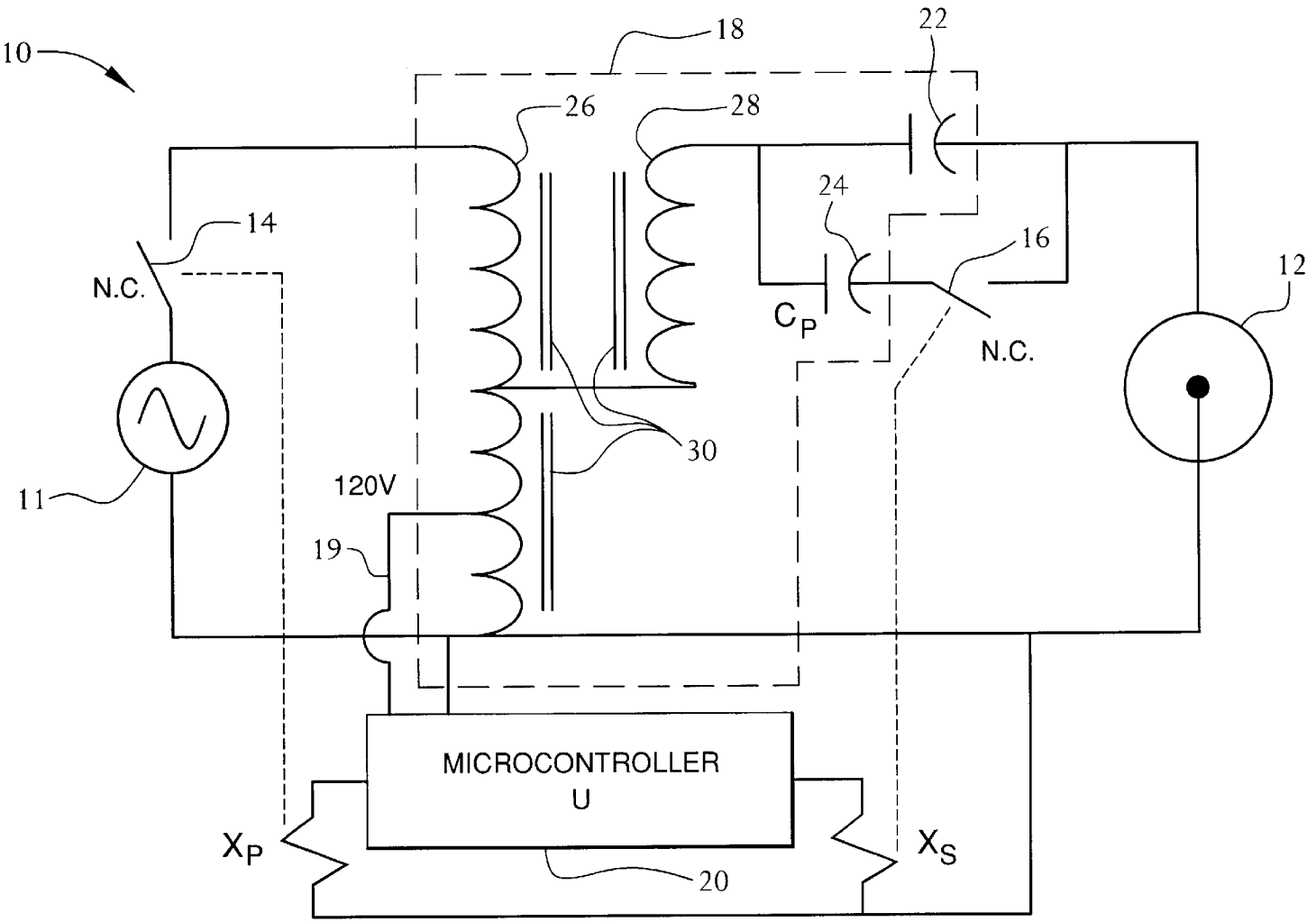
FIG. 1 is a first embodiment of a HID luminaire employing a parallel capacitive relay contact arrangement constructed in accordance with an embodiment of the present invention.

FIG. 1 depicts the ballast circuit 10 provided in accordance with an embodiment of the present invention. The ballast circuit 10 is employed with a metal halide lamp 12 to cycle power via relay contact 14 thus promoting passive end of life light source failure. In addition, the ballast circuit 10 employs an additional relay contact 16 which by action gives anyone in the vicinity of the light source a warning of the impending power outage, via a momentary high to low cycling of the lamp power. The high to low cycling of the lamp 12 is much subtler than an abrupt shutdown and would warn people in the area so that they could prepare mentally and physically for the upcoming outage.

The ballast circuit 10 comprises a power source 11, a conventional constant-wattage ballast 18, described in detail below, two single-pole normally closed relay contacts 14 and 16 controlled by a microcontroller 20, to achieve temporary removal of power as well as the warning indicator, as mentioned above.

The starting and operating characteristics of HID lamps require the lamps to be operated from a ballast which limits the lamp operating current and wattage. One common type of ballast employed to operate HID lamps is a constant wattage autotransformer ballast 18 comprising a magnetic core 30 having two windings, a primary winding 26 and a secondary winding 28 coupled to series capacitors 22 and 24, and a 120 Volt tap 19.

In the first embodiment of the present invention, the ballast circuit 10 employs a constant-wattage autotransformer ballast 18, as detailed above. However, as discussed further below, a magnetically regulated ballast is also employed in an additional embodiment of the present invention. A capacitor 22 is serially coupled to the secondary winding 28, along with a parallel capacitor 24 ($C_p$) and relay contact 16. The lamp 12 is connected across the ballast 18 and coupled serially to parallel capacitors 22 and 24.

Turning to the operation of the ballast circuit 10, the microcontroller 20 is typically programmed to act as a weeklong timer that performs two different functions at the end of the timing cycle. First, for the purpose of safety, it causes the lamp 12 to switch repeatedly from high to low to high for a pre-set period of time in an effort to communicate to anyone in the vicinity that the lamp is about to be extinguished. The switching is accomplished by relay contact 16, which is controlled by microcontroller 20. It should also be noted that the microcontroller 20 is programmable to set the timing cycle to any desired length.

In order to operate the lamp in a reduced power mode from a magnetic ballast 18, the ballast circuit 10 is employed to effect a power reduction provided by the ballast to the lamp. As mentioned above, one type of ballast commonly employed to operate HID lamps is the constant wattage auto-transformer 18 where the two windings 26 and 28 and the core 30 are capacitively coupled to the lamp via capacitors 22 and 24.

The high to low cycling of the lamp 12 is accomplished via the parallel capacitors 22 and 24 and relay contact 16 which alters the net impedance of the ballast 18. Altering the impedance of the ballast 18 effects a change in the power provided to the lamp 12 which thereby effects a change in the luminaire provided by the lamp 12. Specifically, the capacitance of the parallel combination of capacitors 22 and 24 is at a higher value of either capacitor alone. Accordingly, together with the primary winding 26 and secondary winding 28 this parallel capacitance created by capacitors 22 and 24 enables a higher current to be supplied to lamp 12, thereby causing it to operate at a normal energy consumption level or in its full light mode.

Relay contact 16 is activated by microcontroller 20 causing an open circuit condition and removing capacitor 24 from the circuit. Accordingly, capacitor 22 together with the primary winding 26 and secondary winding 28 of ballast 18, however without capacitor 24, supply lamp 12 with substantially lower levels of current to produce a reduced light output from lamp 12. The lamp operates in this mode until the relay contact 16 is activated by microcontroller 20 to put the conditions back into full energy consumption mode again. Accordingly, the microcontroller 20 operates the relay contact 16 in an alternating sequence such that to those in the vicinity it would appear that the lights dim and brighten repeatedly for a pre-determined period of time.

After the above described series of events has occurred, the microcontroller 20 interrupts the power supply 11 connection to the ballast 18 via relay contact 14 thus causing the lamp 12 to extinguish. The microcontroller 20 resets since the voltage source 11 is momentarily disconnected from the ballast 18 thus removing voltage from the microcontroller 20, via the 120 Volt tap 19. Upon closure of relay contact 14 the power supply 11 is again connected to the ballast 18 and microcontroller 20, and the lamp will restart after it cools, beginning the process over again. In the event that the power is interrupted during the timing cycle, the microcontroller 20 resets and proceeds as if from time zero. That is, the microcontroller 20 begins timing the week, for example, from the time the power is restored. Typically, if the microcontroller 20 loses power on a Thursday, and power is restored on Thursday, the microcontroller 20 now cycles the lamp 12 on each successive Thursday, despite the original timing being set for cycling each Saturday. The Saturday cycle schedule can be reacquired manually, however, by momentarily interrupting the supply 11 at, for example, 10 A. M. Saturday, if desired.

Accordingly, as long as the lamp 12 is cycled once a week, not on any particular day, this satisfies all of the safety recommendations currently being made by manufacturers of metal halide lamps. If this system were a standard 400 Watt metal-halide lamp, then an appropriate value for capacitor 24 is 7.0 microfarads to complement the series capacitor having a value of 17.0 microfarads.

Figure 2:
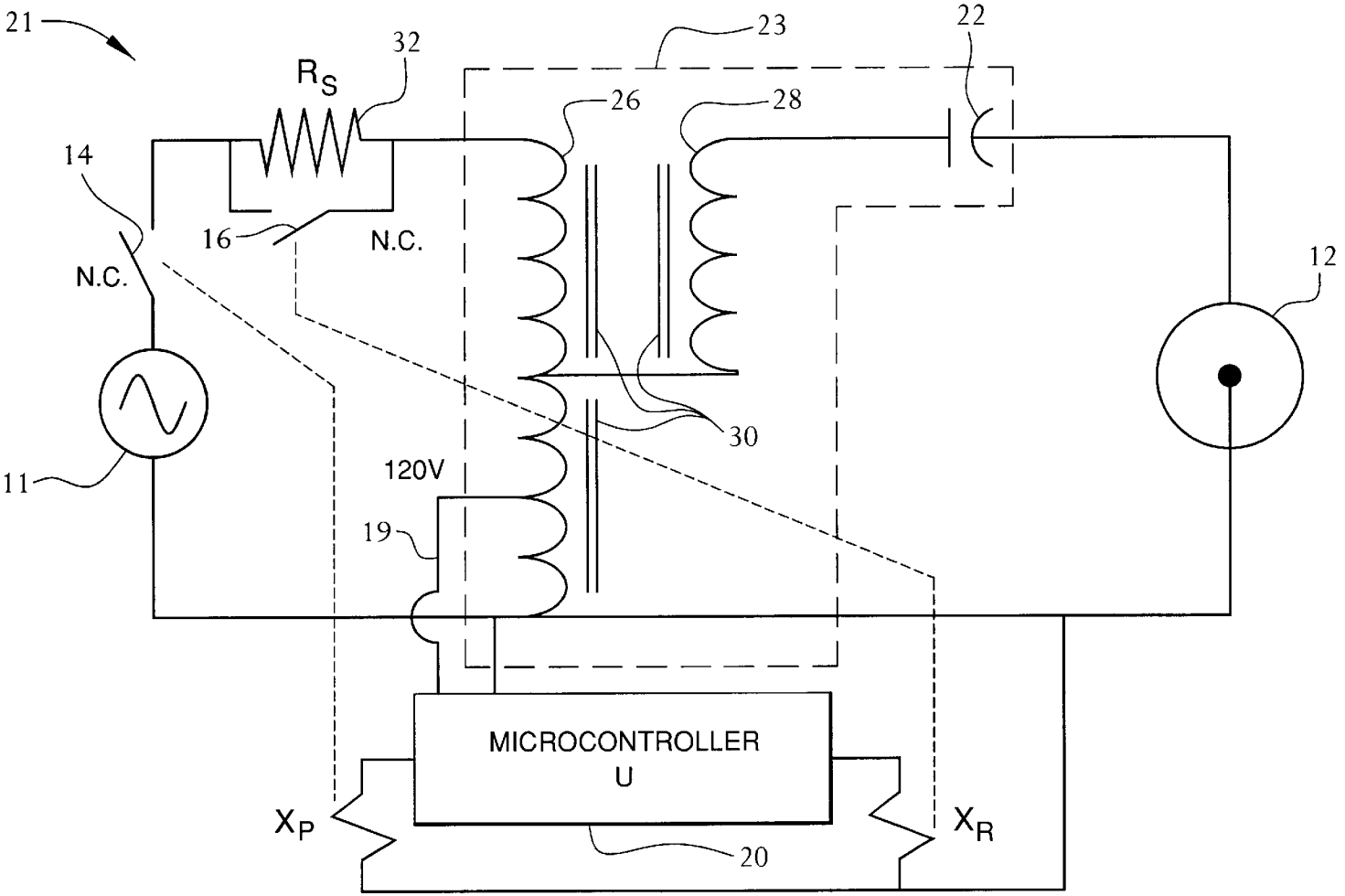
FIG. 2 is a second embodiment of a HID luminaire employing a series resistive and bypass relay contact arrangement coupled to the primary winding of a ballast constructed in accordance with an embodiment of the present invention.

FIG. 2 is illustrative of an additional embodiment of the present invention. In this case, the microcontroller 20 controls the normally closed relay contacts 14 and 16 as in the first embodiment of the present invention, as detailed above. However, in this additional embodiment, the relay contact 16 is placed across a series resistor 32 which is in turn coupled to the primary winding 26 of the ballast 18. Additionally, the relay contact 14 is used to interrupt the power being drawn by the ballast 23 thus causing the lamp 12 to extinguish, via the 120 Volt tap 19. Specifically, when the relay contact 16 is cycled from closed to open, the resistor 32 is placed in series with the primary winding 26 of ballast 18 reducing the effective supply voltage available to the ballast 23. This, in turn, reduces the power delivered to the lamp 12 and causes the lamp's luminous output to drop. The opening and closing of the relay contact 16 continues for a period of time causing the lamp 12 to dim and brighten, in an alternating fashion, as described in connection with FIG. 1. The increasing and decreasing light output is adequate to indicate that the lamp 12 is soon to be extinguished. Additionally, relay contact 14 serves the same function as described in connection with FIG. 1. That is, upon expiration of the warning indicator, or high and low cycling of the lamp 12 output, via relay contact 16, microcontroller 20 activates the normally closed relay contact 14 to interrupt power to the lamp 12 for an adequate amount of time to allow the lamp to extinguish.

It is important to note that an advantage of an embodiment of the present invention of FIG. 2 over the embodiment illustrated in FIG. 1 is that the ballast circuit 21 of FIG. 2 is entirely self-contained in a relatively small volume without the need for a special dual capacitor arrangement of ballast 18 (e.g., capacitors 22 and 24) as shown in FIG. 1. Accordingly, the embodiment of the present invention depicted in FIG. 2 can be retrofit into an existing HID luminaire by modifying the wiring to the primary winding 26 of the ballast 23.

Further, it is important to note that the value of the resistor 32 is large enough to provide a sufficiently visible effect to any one in the vicinity of the luminaire, upon high and low cycling of the lamp 12 output via relay contact 16 during the warning period. However, the resistor value should be small enough to ensure heat dissipation is minimal. Accordingly, if the total period of cycling (e.g., cycling of power to indicate termination of lamp operation) is kept under a minute, and the duty cycle is kept to approximately 50%, then the heat dissipated by a 20 Watt or higher wire wound resistor is not large enough to result in component failure. Although the resistor 32 has to withstand high instantaneous power levels, the above described conditions (e.g., length of cycling time, and duty cycle<50%) allow the components to function within acceptable limits.

Figure 3:
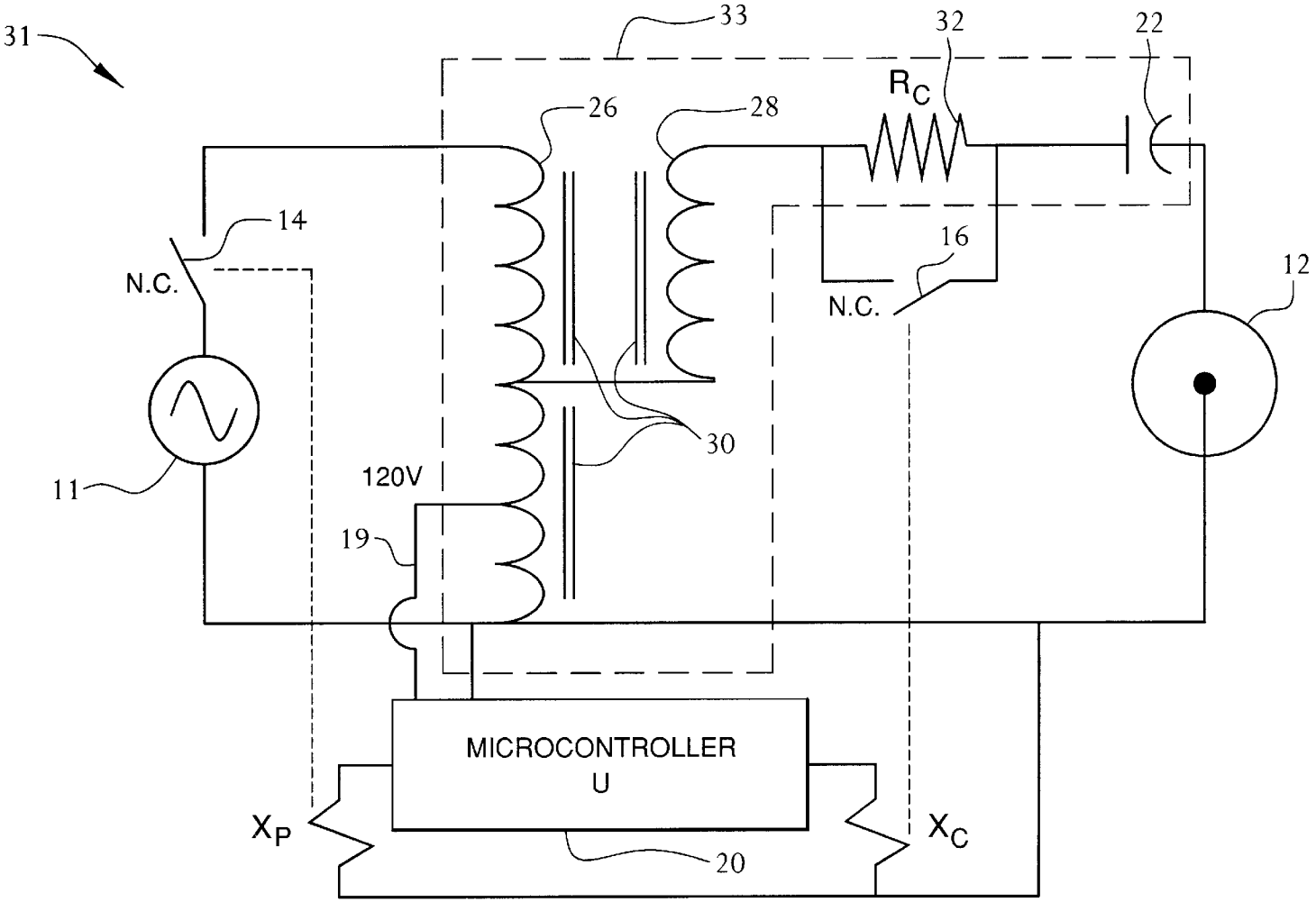
FIG. 3 is an additional embodiment of a HID luminaire employing a series resistive and bypass relay contact arrangement coupled to the secondary winding of a ballast constructed in accordance with an embodiment of the present invention.

Turning now to the ballast circuit 31 of FIG. 3 which is illustrative of an additional embodiment of the present invention. This embodiment comprises similar components to FIGS. 1 and 2, for example, microcontroller 20, power source 11, the relay contact 14 and relay contact 16 controlled by microcontroller 20, and lamp 12. However, in FIG. 3, the ballast 33 comprises a core 30 with windings 26 and 28, and resistor 32 in series with capacitor 22. The relay contact 16 is in parallel with resistor 32. Additionally, the resistor 32 is in series with the secondary winding of the ballast 33, thus when relay contact 16 is open the impedance of the ballast circuit 21 is increased. This in turn reduces the power delivered to the lamp 12 and causes the lamp output to drop. Resistor 32 has a value of 30 ohms in this configuration, providing a sufficient reduction in lamp power and lumen output.

Accordingly, in operation, microcontroller 20 operates relay contact 16 from a normally closed position to an open position, momentarily. Opening of relay contact 16 changes the impedance of the ballast circuit 31 thereby reducing current flowing to lamp 12. This produces a visible dimming of the lamp 12 noticeable to anyone in the vicinity of the lamp 12. The microcontroller repeats this process (e.g., opening and closing the relay contact 16) for a predetermined amount of time. After the expiration of this predetermined amount of time or warning period, the microcontroller 20 activates the normally closed relay contact 14, thus disconnecting the power source 11 from the ballast 33 and extinguishing power to the lamp 12, via a 120 Volt tap 19. After a selected period of time, the microcontroller energizes contact 14 into a closed position and allows the lamp to begin to resume operation, until the next cycling period, for example, one week later. Although the ballast circuits of FIGS. 2 and 3 are similar, ballast circuit 31 of FIG. 3 is less likely to be retrofit due to the placement of the relay contact 16 and resistor 32 in series with the secondary winding 28.

Figure 4:
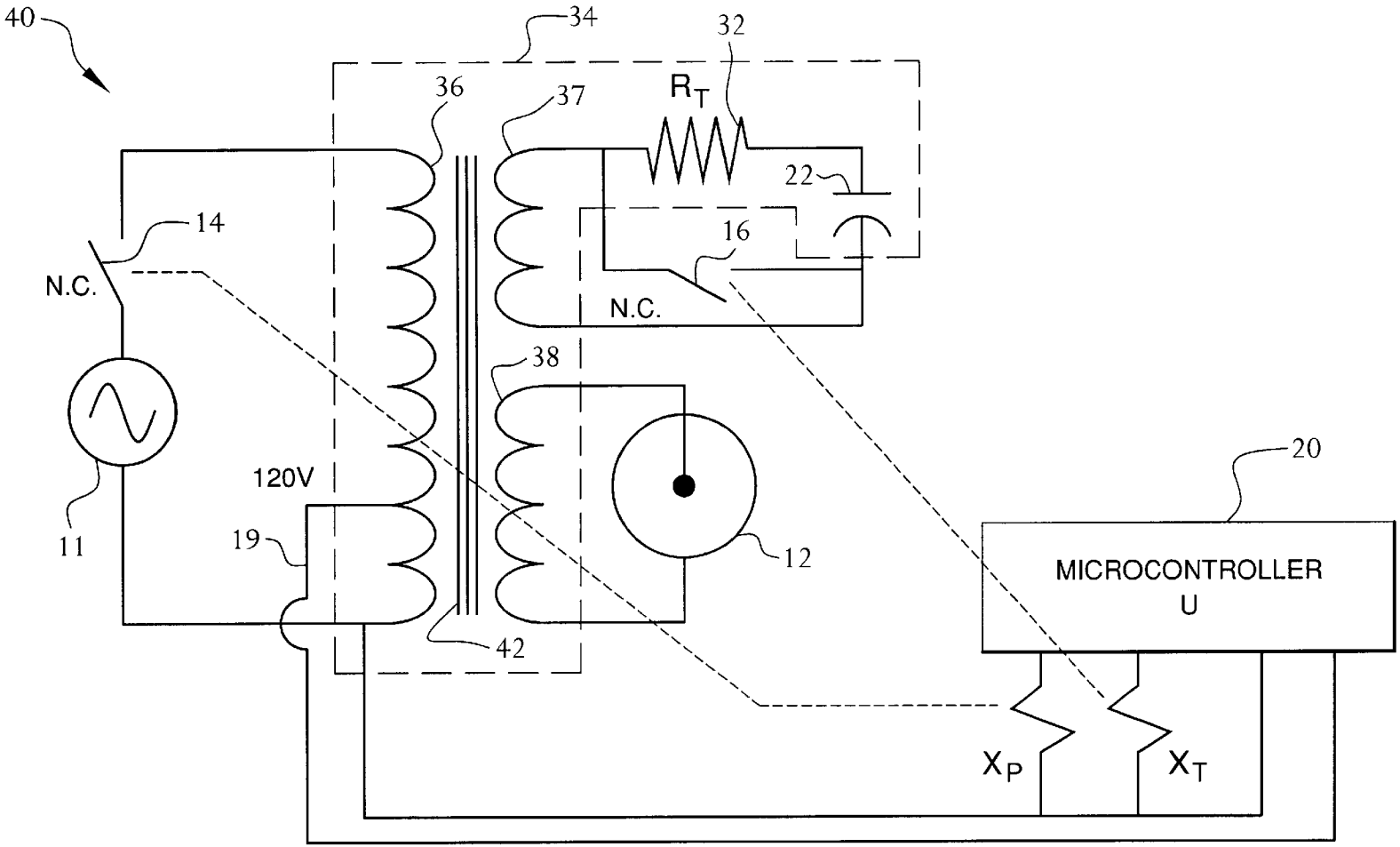
FIG. 4 is another embodiment of a HID luminaire employing a magnetically regulated ballast and a series resistive and bypass relay contact arrangement constructed in accordance with an embodiment of the present invention.

The ballast circuit 40 of FIG. 4 is yet an additional embodiment of the present invention. The main difference between the ballast circuit 40 of FIG. 4 and that of FIG. 3, for example, is the use of a magnetically regulated ballast 34 in FIG. 4. The regulating ballast 34 comprises a 120 Volt tap 19 connected to the primary coil 36, a secondary winding 38, and a tertiary winding 37. Further, the tertiary winding 37 has a capacitor 22 connected in parallel, along with a resistor 32 and a relay contact 16 coupled in parallel to the resistor 32. The three windings are coupled together by a laminated core 42.

Accordingly, in operation when the time out period is attained, the microcontroller 20 activates the normally closed relay contact 16 into an open position. The current flows through a current limiting resistor 32 and reduces the current to the tertiary winding 37. This, in turn, limits the current flow to the secondary winding 38, and therefore causing lamp 12 to dim. The microcontroller 20 repeatedly activates and de-activates relay contact 16 for a predetermined period of time in order to give the effect of a dimming lumen output alternating with an increasing lumen output to anyone standing in the vicinity of the lamp 12. As mentioned above, after expiration of the predetermined period of time, the microcontroller 20 operates the normally closed relay contact 14 in order to disconnect the power supply 11 from the ballast 34, via a 120 Volt tap 19. Upon expiration of an additional pre-determined period of time, the microcontroller releases the relay contact back into a closed position to enable the lamp 12 to resume operation, until the next cycling period, typically a week later.

Although only several exemplary embodiments of the present invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A luminaire assembly comprising:

ballast;

a lamp coupled to said ballast and at least one capacitor in series with said lamp; and a first relay contact coupled to said ballast via a circuit device, said first relay contact operable to alternatively decrease power to said lamp for a selected period of time, said first relay contact controlled by a processing device coupled to said ballast and said lamp;

a second relay contact coupled to said processing device and a power source for said ballast, said second relay contact operable to momentarily extinguish and fully restore power to said ballast.

2. A luminaire as claimed in claim 1, wherein said circuit device comprises a resistive device in parallel with said relay contact.

3. A luminaire as claimed in claim 1, wherein said circuit device comprises at least one capacitor in series with said relay contact.

4. A luminaire as claimed in claim 1, wherein said ballast comprises a constant-wattage autotransformer ballast.

5. A luminaire as claimed in claim 1, wherein said ballast comprises a magnetically regulated ballast.

6. A luminaire as claimed in claim 1, wherein said processing device comprises at least one of a microcontroller and a microprocessor.

7. A luminaire assembly comprising:

a lamp;

a ballast; and a processing device operable to generate a warning indicator after expiration of a pre-selected period of time, said warning indicator to indicate impending termination of power to said lamp for a pre-determined period of time, and after expiration of said pre-determined period of time said processing device operable to restore said lamp to an operating condition in order to reduce arc tube failure.

8. A luminaire as claimed in claim 7, wherein said warning indicator comprise said processing device operable to control a relay contact coupled to a circuit, to alternatively decrease, for a selected period of time, the incoming power to said ballast.

9. A luminaire as claimed in claim 8, wherein said circuit comprising parallel capacitors, and a resistor in parallel with said relay contact.

10. A luminaire as claimed in claim 7, wherein said pre-selected period of time comprises one week.

11. A luminaire as claimed in claim 7, wherein said ballast comprises a constant wattage ballast.

12. A luminaire as claimed in claim 7, wherein said ballast comprises a magnetically regulated ballast.

13. A luminaire as claimed in claim 7, wherein said processing device comprises at least one of microcontroller and a microprocessor.

14. A method for preventing arc tube failure within a luminaire comprising the steps of:

initiating a timer within a processing device to time for a pre-selected period of time;

initiating a warning indicator for a pre-determined period of time, after expiration of said pre-selected period of time; and terminating power momentarily to said ballast after said pre-determined period of time.

15. A method as claimed in claim 14, wherein said second initiating step further comprises the step of:

operating a relay contact, coupled to at least one circuit device, via said processing device by alternatively decreasing for a selected period of time, incoming power to a ballast within said luminaire.

16. A system for controlling a lamp, comprising:

a processing device adapted to generate a warning of impending termination of power to a ballast which drives said lamp, and being further adapted to terminate power to said ballast after providing said warning, said warning comprising changing a power level driving said lamp for a pre-selected period of time.

17. A system as claimed in claim 16, wherein said processing device adapted to restore power to said ballast, after expiration of a pre-determined period of time.

18. A system as claimed in claim 16, wherein said processing device adapted to generate said warning and terminate said power after a selectable amount of time.

19. A system as claimed in claim 18, wherein said selectable amount of time includes one week.

* * * * *